US010465528B2

(12) United States Patent
Spangler et al.

(10) Patent No.: US 10,465,528 B2
(45) Date of Patent: Nov. 5, 2019

(54) AIRFOIL TURN CAPS IN GAS TURBINE ENGINES

(71) Applicant: United Technologies Corporation, Farmington, CT (US)

(72) Inventors: Brandon W. Spangler, Vernon, CT (US); Dominic J. Mongillo, Jr., West Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 348 days.

(21) Appl. No.: 15/426,082

(22) Filed: Feb. 7, 2017

(65) Prior Publication Data

US 2018/0223676 A1 Aug. 9, 2018

(51) Int. Cl.

| | |
|---|---|
| ***F01D 5/18*** | (2006.01) |
| ***F01D 9/06*** | (2006.01) |
| *F01D 9/02* | (2006.01) |
| *F01D 25/12* | (2006.01) |

(52) U.S. Cl.

CPC ..... *F01D 5/187* (2013.01); *F01D 9/065* (2013.01); *F01D 5/189* (2013.01); *F01D 9/02* (2013.01); *F01D 25/12* (2013.01); *F05D 2220/32* (2013.01); *F05D 2230/21* (2013.01); *F05D 2240/125* (2013.01); *F05D 2240/126* (2013.01);

(Continued)

(58) Field of Classification Search

CPC . F01D 9/065; F01D 9/02; F01D 5/187; F01D 5/189; F05D 2250/185

See application file for complete search history.

(56) References Cited

U.S. PATENT DOCUMENTS 4,257,737 A 3/1981 Andress et al.
4,411,597 A * 10/1983 Koffel ..... B23P 6/005 416/224
5,393,198 A 2/1995 Noda et al.
(Continued)

FOREIGN PATENT DOCUMENTS

EP 0735240 A1 10/1996
EP 3106621 A2 12/2016
(Continued)

OTHER PUBLICATIONS

European Search Report, European Application No. 17206024.6, dated Sep. 26, 2018, European Patent Office; European Search Report 9 pages.

*Primary Examiner* — Dwayne J White
*Assistant Examiner* — Wesley Le Fisher
(74) *Attorney, Agent, or Firm* — Cantor Colburn LLP

(57) ABSTRACT

Turn caps for airfoils of gas turbine engines including cavity sidewalls, a first turn cap divider extending between the cavity sidewalls and defining a turning cavity between the first turn cap divider and the cavity sidewalls, and a second turn cap divider disposed radially inward within the turning cavity. A first turning path is defined between the first turn cap divider and the second turn cap divider and a second turning path is defined radially inward of the second turn cap divider and a merging chamber is formed in the turn cap wherein fluid flows through the first turning path and the second turning path are merged, the merging chamber, the first turning path, and the second turning path forming the turning cavity.

19 Claims, 12 Drawing Sheets

(52) U.S. Cl.
CPC .... *F05D 2240/81* (2013.01); *F05D 2250/185* (2013.01); *F05D 2260/221* (2013.01)

(56) References Cited

U.S. PATENT DOCUMENTS

| | | | | |
|---|---|---|---|---|
| 5,511,309 | A | 4/1996 | Beabout | |
| 5,525,038 | A | 6/1996 | Sharma et al. | |
| 6,126,394 | A | 10/2000 | Matsuda | |
| 6,299,412 | B1 | 10/2001 | Wood et al. | |
| 7,785,072 | B1 | 8/2010 | Liang et al. | |
| 8,192,153 | B2 | 6/2012 | Harvey et al. | |
| 8,202,054 | B2 | 6/2012 | Liang | |
| 8,292,582 | B1 | 10/2012 | Liang | |
| 8,511,999 | B1 | 8/2013 | Kimmel et al. | |
| 8,562,295 | B1 | 10/2013 | Liang | |
| 8,602,741 | B2 | 12/2013 | Ahmad et al. | |
| 8,678,766 | B1 | 3/2014 | Liang | |
| 8,821,111 | B2 | 9/2014 | Gear et al. | |
| 8,864,438 | B1 * | 10/2014 | Lee | F01D 5/188 415/1 |
| 8,870,524 | B1 * | 10/2014 | Liang | F01D 9/065 415/115 |
| 9,550,267 | B2 | 1/2017 | Beckman et al. | |
| 9,631,499 | B2 | 4/2017 | Liang | |
| 2005/0276698 | A1 * | 12/2005 | Kvasnak | F01D 5/005 416/115 |
| 2006/0222495 | A1 | 10/2006 | Liang | |
| 2007/0258825 | A1 | 11/2007 | Shadbolt et al. | |
| 2009/0068023 | A1 | 3/2009 | Liang | |
| 2009/0148287 | A1 | 6/2009 | Suciu et al. | |
| 2009/0324423 | A1 * | 12/2009 | Liang | F01D 5/186 416/97 R |
| 2010/0054915 | A1 * | 3/2010 | Devore | F01D 5/189 415/116 |
| 2010/0226789 | A1 | 9/2010 | Liang | |
| 2011/0058949 | A1 | 3/2011 | Marra | |
| 2014/0050893 | A1 | 2/2014 | Paige et al. | |
| 2014/0083116 | A1 | 3/2014 | Crites et al. | |
| 2014/0169962 | A1 | 6/2014 | Lee | |
| 2016/0069184 | A1 | 3/2016 | Ribic et al. | |
| 2016/0312632 | A1 * | 10/2016 | Hagan | F01D 9/041 |
| 2016/0376897 | A1 | 12/2016 | Spangler | |
| 2018/0195397 | A1 | 7/2018 | Spangler | |
| 2018/0306036 | A1 | 10/2018 | Spangler et al. | |
| 2018/0320531 | A1 | 11/2018 | Spangler et al. | |

FOREIGN PATENT DOCUMENTS

| | | | |
|---|---|---|---|
| EP | 3109405 | A1 | 12/2016 |
| EP | 3128130 | A1 | 2/2017 |
| EP | 3184738 | A1 | 6/2017 |
| EP | 3184745 | A1 | 6/2017 |
| EP | 3284908 | A2 | 2/2018 |

* cited by examiner

AIRFOIL TURN CAPS IN GAS TURBINE ENGINES

STATEMENT REGARDING FEDERALLY SPONSORED RESEARCH OR DEVELOPMENT

This invention was made with government support under Contract No. FA8650-09-D-2923-0021 awarded by the U.S. Air Force. The government has certain rights in the invention.

BACKGROUND

The subject matter disclosed herein generally relates to cooling flow in airfoils of gas turbine engines and, more particularly, to airfoil turn caps for cooling flow passages within airfoils in gas turbine engines.

In gas turbine engines, cooling air may be configured to flow through an internal cavity of an airfoil to prevent overheating. Gas temperature profiles are usually hotter at the outer diameter than at the inner diameter of the airfoils. In order to utilize cooling flow efficiently and minimize heat pickup and pressure loss, the cross-sectional area of the internal cooling flow may be configured to vary so that Mach numbers remain low where heat transfer is not needed (typically the inner diameter) and high Mach numbers where heat transfer is needed (typically the outer diameter). To do this in a casting, the walls of the airfoils tend to be thick in some areas and thin in other areas, which may add weight to the engine in which the airfoils are employed. Previously, baffles have been used to occupy some of the space within the internal cavity of the airfoils, referred to herein as "space-eater" baffles. The baffles extend from one end of the cavity all the way through the other end of the cavity within the airfoil. This configuration may result in relatively high Mach numbers to provide cooling throughout the cavity. Further, such configuration may provide high heat transfer, and pressure loss throughout the cavity.

In order to achieve metal temperatures required to meet full life with the cooling flow allocated, the "space-eater" baffles are required to be used inside an airfoil serpentine cooling passage. The serpentine turns are typically located outside gas path endwalls to allow the "space-eater" baffles to extend all the way to the gas path endwall (e.g., extend out of the cavity of the airfoil). However, because the airfoil may be bowed, the turn walls must also follow the arc of the bow to provide clearance for the "space-eater" baffles to be inserted. During manufacture, because the wax die end blocks do not have the same pull direction as the bow of the airfoil, the turn walls cannot be cast without creating a die-lock situation and trapping the wax die.

Thus it is desirable to provide means of controlling the heat transfer and pressure loss in airfoils of gas turbine engines, particularly at the endwall turn for serpentine gas paths.

SUMMARY

According to some embodiments, turn caps for airfoils of gas turbine engines are provided. The turn caps include cavity sidewalls, a first turn cap divider extending between the cavity sidewalls and defining a turning cavity between the first turn cap divider and the cavity sidewalls, and a second turn cap divider disposed radially inward within the turning cavity. A first turning path is defined between the first turn cap divider and the second turn cap divider and a second turning path is defined radially inward of the second turn cap divider, and a merging chamber is formed in the turn cap wherein fluid flows through the first turning path and the second turning path are merged, the merging chamber, the first turning path, and the second turning path forming the turning cavity.

In addition to one or more of the features described herein, or as an alternative, further embodiments of the turn caps may include that the cavity sidewalls, the first turn cap divider, and the second turn cap divider are integrally formed.

In addition to one or more of the features described herein, or as an alternative, further embodiments of the turn caps may include a platform of an airfoil, wherein the cavity sidewalls are integrally formed with the platform.

In addition to one or more of the features described herein, or as an alternative, further embodiments of the turn caps may include that the first turn cap divider and the second turn cap divider are fixedly attached to the cavity sidewalls.

In addition to one or more of the features described herein, or as an alternative, further embodiments of the turn caps may include that the cavity sidewalls include a first landing and a second landing, wherein the first turn cap divider is fixedly attached to the first landing and the second turn cap divider is fixedly attached to the second landing.

In addition to one or more of the features described herein, or as an alternative, further embodiments of the turn caps may include that a distance between the first landings of the cavity sidewalls is greater than a distance between the second landings of the cavity sidewalls.

In addition to one or more of the features described herein, or as an alternative, further embodiments of the turn caps may include that the first turn cap divider has a first segment and a second segment, wherein first segment has a geometry to turn flow.

In addition to one or more of the features described herein, or as an alternative, further embodiments of the turn caps may include that the second turn cap divider has a first segment and a second segment, wherein the second segment of the second turn cap is parallel to the second segment of the first turn cap divider.

In addition to one or more of the features described herein, or as an alternative, further embodiments of the turn caps may include that the first turning path and the second turning path each define circumferential aspect ratios.

According to some embodiments, airfoils of gas turbine engines are provided. The airfoils include a hollow body defining a first up-pass cavity, a second up-pass cavity, and a first down-pass cavity, the hollow body having an inner diameter end and an outer diameter end, a first airfoil platform at one of the inner diameter end and the outer diameter end of the hollow body, the first airfoil platform having a gas path surface and a non-gas path surface, wherein the hollow body extends from the gas path surface, a first up-pass cavity opening formed in the non-gas path surface of the first airfoil platform fluidly connected to the first up-pass cavity, a second up-pass cavity opening formed in the non-gas path surface of the first airfoil platform fluidly connected to the second up-pass cavity, a first down-pass cavity opening formed in the non-gas path surface of the first airfoil platform fluidly connected to the first down-pass cavity, and a first turn cap fixedly attached to the first airfoil platform on the non-gas path surface covering the first and second up-pass cavity openings and the first down-pass cavity opening of the first airfoil platform and defining a first turning cavity. The first turn cap has cavity sidewalls, a first turn cap divider extending between the cavity sidewalls and defining the first turning cavity between the first turn cap divider and the cavity sidewalls, and a second turn cap divider disposed radially inward within the first turning cavity between the first turn cap divider and the non-gas path surface of the first airfoil platform. A first turning path is defined between the first turn cap divider and the second turn cap divider and a second turning path is defined radially inward of the second turn cap divider, and a merging chamber is formed in the turn cap wherein fluid flows through the first turning path and the second turning path are merged, the first turning cavity including the first turning path, the second turning path, and the merging chamber.

In addition to one or more of the features described herein, or as an alternative, further embodiments of the airfoils may include that the cavity sidewalls, the first turn cap divider, and the second turn cap divider are integrally formed.

In addition to one or more of the features described herein, or as an alternative, further embodiments of the airfoils may include that the cavity sidewalls are integrally formed with the first airfoil platform.

In addition to one or more of the features described herein, or as an alternative, further embodiments of the airfoils may include that the first turn cap divider and the second turn cap divider are fixedly attached to the cavity sidewalls.

In addition to one or more of the features described herein, or as an alternative, further embodiments of the airfoils may include that the cavity sidewalls include a first landing and a second landing, wherein the first turn cap divider is fixedly attached to the first landing and the second turn cap divider is fixedly attached to the second landing.

In addition to one or more of the features described herein, or as an alternative, further embodiments of the airfoils may include that a distance between the first landings of the cavity sidewalls is greater than a distance between the second landings of the cavity sidewalls.

In addition to one or more of the features described herein, or as an alternative, further embodiments of the airfoils may include that the first turn cap divider has a first segment and a second segment, wherein first segment has a geometry to turn flow.

In addition to one or more of the features described herein, or as an alternative, further embodiments of the airfoils may include that the second turn cap divider has a first segment and a second segment, wherein the second segment of the second turn cap is parallel to the second segment of the first turn cap divider.

In addition to one or more of the features described herein, or as an alternative, further embodiments of the airfoils may include that the first turning path and the second turning path each define circumferential aspect ratios.

In addition to one or more of the features described herein, or as an alternative, further embodiments of the airfoils may include a second airfoil platform at the other of the inner diameter end and the outer diameter end of the hollow body and a second turn cap fixedly attached to the second airfoil platform.

In addition to one or more of the features described herein, or as an alternative, further embodiments of the airfoils may include a "space-eater" baffle positioned in at least one of the up-pass cavities.

Technical effects of embodiments of the present disclosure include turn caps to be installed to platforms of airfoils to provide turning paths to improve the convective cooling of the airfoil within airfoil bodies and more particularly aid in turning airflows to enable low- or no-loss merging of multiple air streams within a turn cap.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
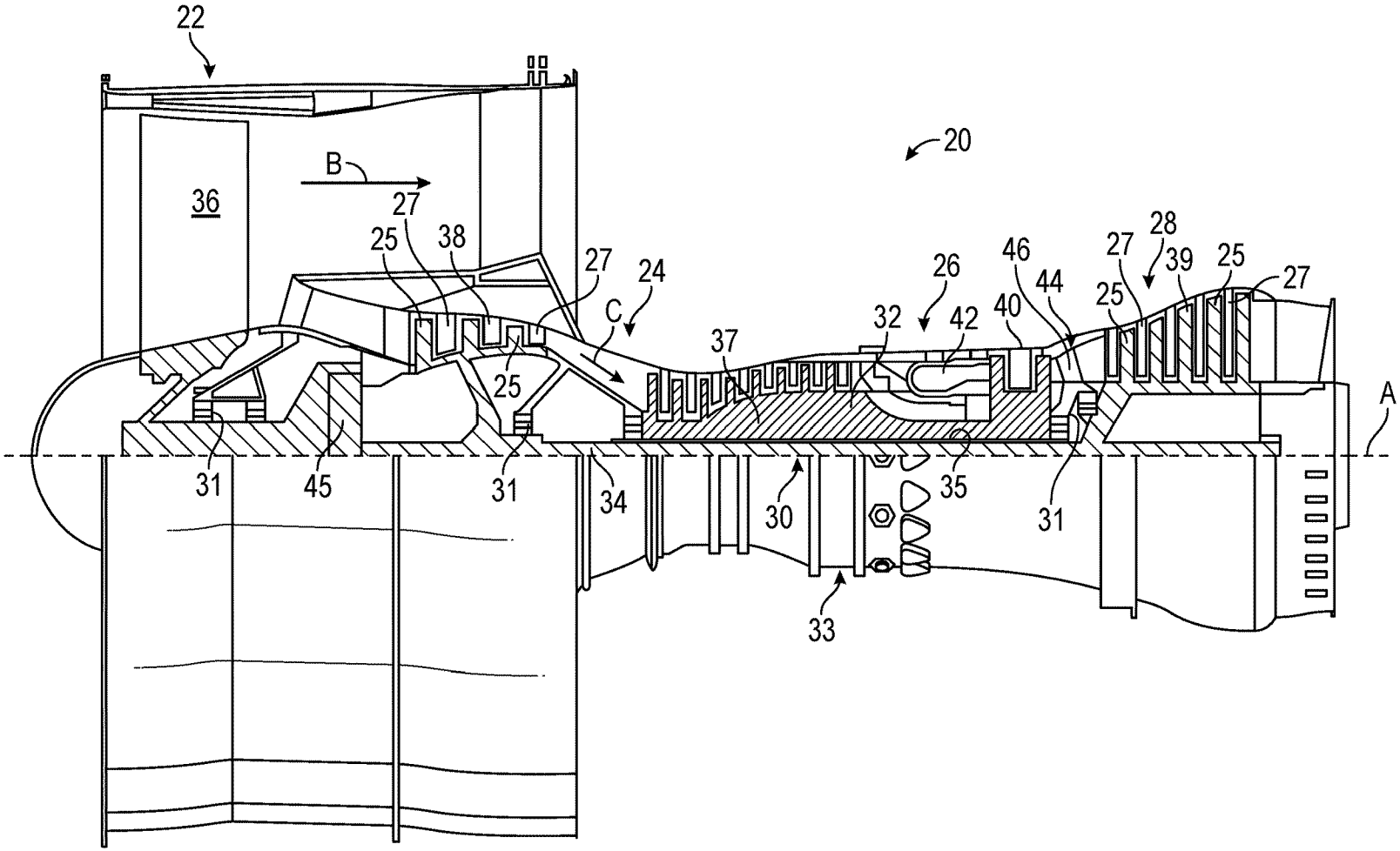
FIG. 1A is a schematic cross-sectional view of a gas turbine engine that may employ various embodiments disclosed herein.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}° R)/(518.7° R)]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as partial cavity baffles are discussed below.

Figure 1B:
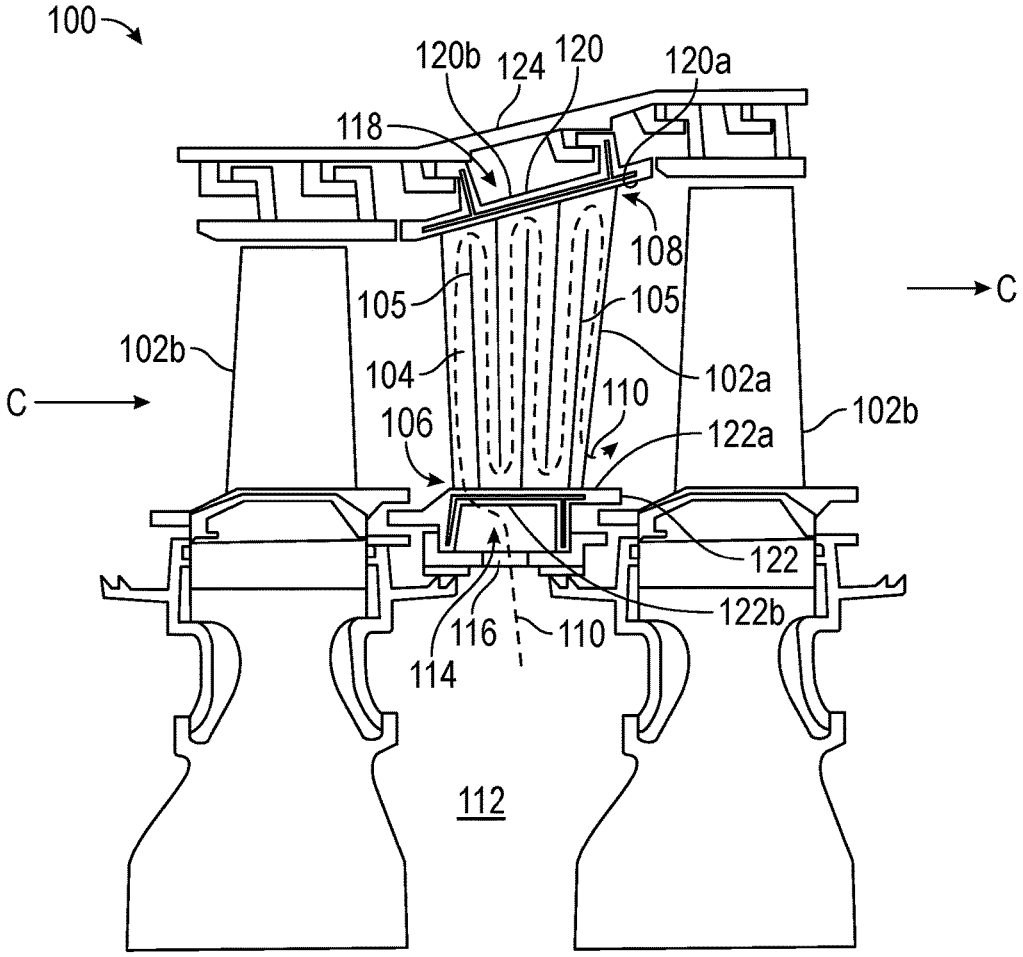
FIG. 1B is a partial schematic view of a turbine section of the gas turbine engine of FIG. 1A.

FIG. 1B is a partial schematic view of a turbine section 100 that may be part of the gas turbine engine 20 shown in FIG. 1A. Turbine section 100 includes one or more airfoils 102*a*, 102*b*. As shown, some airfoils 102*a* are stationary stator vanes and other airfoils 102*b* are blades of turbines disks. The airfoils 102*a*, 102*b* are hollow body airfoils with one or more internal cavities defining a number of cooling channels 104 (schematically shown in vane 102*a*). The airfoil cavities 104 are formed within the airfoils 102*a*, 102*b* and extend from an inner diameter 106 to an outer diameter 108, or vice-versa. The airfoil cavities 104, as shown in the vane 102*a*, are separated by partitions 105 that extend either from the inner diameter 106 or the outer diameter 108 of the vane 102*a*. The partitions 105, as shown, extend for a portion of the length of the vane 102*a* to form a serpentine passage within the vane 102*a*. As such, the partitions 105 may stop or end prior to forming a complete wall within the vane 102*a*. Thus, each of the airfoil cavities 104 may be fluidly connected. In other configurations, the partitions 105 can extend the full length of the respective airfoil. Although not shown, those of skill in the art will appreciate that the blades 102*b* can include similar cooling passages formed by partitions therein.

As shown, counting from a leading edge on the left, the vane 102*a* may include six airfoil cavities 104 within the hollow body: a first airfoil cavity on the far left followed by a second airfoil cavity immediately to the right of the first airfoil cavity and fluidly connected thereto, and so on. Those of skill in the art will appreciate that the partitions 105 that separate and define the airfoil cavities 104 are not usually visible and FIG. 1B is merely presented for illustrative and explanatory purposes.

The airfoil cavities 104 are configured for cooling airflow to pass through portions of the vane 102*a* and thus cool the vane 102*a*. For example, as shown in FIG. 1B, an airflow path 110 is indicated by a dashed line. In the configuration of FIG. 1B, air flows from a rotor cavity 112 and into an airfoil inner diameter cavity 114 through an orifice 116. The air then flows into and through the airfoil cavities 104 as indicated by the airflow path 110. Positioned at the outer diameter of the airfoil 102, as shown, is an outer diameter cavity 118.

As shown in FIG. 1B, the vane 102*a* includes an outer diameter platform 120 and an inner diameter platform 122. The vane platforms 120, 122 are configured to enable attachment within and to the gas turbine engine. For example, as appreciated by those of skill in the art, the inner diameter platform 122 can be mounted between adjacent rotor disks and the outer diameter platform 120 can be mounted to a case 124 of the gas turbine engine. As shown, the outer diameter cavity 118 is formed between the case 124 and the outer diameter platform 120. Those of skill in the art will appreciate that the outer diameter cavity 118 and the inner diameter cavity 114 are outside of or separate from the core flow path C. The cavities 114, 118 are separated from the core flow path C by the platforms 120, 122. Thus, each platform 120, 122 includes a respective core gas path surface 120*a*, 122*a* and a non-gas path surface 120*b*, 122*b*. The body of the vane 102*a* extends from and between the gas path surfaces 120*a*, 122*a* of the respective platforms 120, 122. In some embodiments, the platforms 120, 122 and the body of the vane 102*a* are a unitary body.

Air is passed through the airfoil cavities of the airfoils to provide cooling airflow to prevent overheating of the airfoils and/or other components or parts of the gas turbine engine. The flow rate through the airfoil cavities may be a relatively low flow rate of air and because of the low flow rate, the convective cooling and resultant internal heat transfer coefficient may be too low to achieve the desired metal temperatures of the airfoils. One solution to this is to add one or more baffles into the airfoil cavities. That is, in order to achieve desired metal temperatures to meet airfoil full-life with the cooling flow allocated based on turbine engine design, "space-eater" baffles may be used inside airfoil serpentine cooling passages (e.g., within the airfoil cavities 104 shown in FIG. 1B). In this instance, the "space-eater" baffle serves as a way to consume internal cavity area/volume in order to reduce the available cross-sectional area through which air can flow. This enables the local flow per unit area to be increased which in turn results in higher cooling cavity Reynolds Numbers and internal convective heat transfer. In some of these configurations, the serpentine turns must be located outside the gas path endwalls (e.g., outside of the airfoil body) to allow the "space-eater" baffles to extend all the way to the gas path endwall. That is, the "space-eater" baffles may be required to extend into the outer diameter cavity 118 or the inner diameter cavity 114. In some circumstances, depending upon the method of manufacture, the radial cooling cavities 104 must be accessible to allow for the insertion of the "space-eater" baffles. However, those of skill in the art will appreciate that if the airfoil cooling configurations are fabricated using alternative additive manufacturing processes and/or fugitive core casting processes the "space-eater" baffles may be fabricated as an integral part or component of the internal convective cooling design concurrently with the rest of the core body and cooling circuit.

Additionally, as will be appreciated by those of skill in the art, a cooling scheme generally requires the merging of cooling flow from several radial passages extending along the pressure and suction sides of the airfoil with minimum pressure loss. For example, a cooling flow from the leading edge-most passages of the airfoil must be able to get to the trailing edge passage(s) with as little pressure loss as possible, e.g., as traveling from the leading edge on the left of the airfoil 102*a* in FIG. 1B to the trailing edge on the right of the airfoil 102*a*. Alternatively, in some embodiments, the direction of the serpentine flow may flow from the trailing edge-most passages of the airfoil toward the leading edge passage(s) with as little pressure loss as possible. To avoid unnecessary turbulence generated by the merging of multi-directional air flow streams that are flowing with varying velocities and pressures, the cooling flow must remain in each passage as it transitions from radial flow to axial flow (e.g., moving in a direction from leading edge toward trailing edge of the airfoil or, conversely, from trailing edge toward the leading edge of the airfoil). Depending on the particular configuration of the turbine, housing, engine, etc., there may be a limited radial distance to merge the cooling flow, particularly when transitioning from one direction or orientation of flow to another direction or orientation of flow.

In cooling passages, the channel defining the passage has an aspect ratio associated or defined by the dimensions of the channel that are perpendicular to the flow direction. As will be appreciated by those of skill in the art, the term aspect ratio is typically used to define the relationship between the dimensions of a channel perpendicular to the flow direction. As used herein, the name of an aspect ratio will refer to the orientation of the longest dimension perpendicular to the flow direction. For example, an "axial aspect ratio" means the longest dimension that is perpendicular to the flow direction (e.g., $W_1$ in FIG. 2B) is in an axial orientation. A "circumferential aspect ratio" means the longest dimension that is perpendicular to the flow direction (e.g., $W_2$ in FIG. 2C) is in a circumferential orientation. A "radial aspect ratio" means the longest dimension that is perpendicular to the flow direction is in a radial orientation.

For example, with reference to FIG. 1B, the leading edge passage of airflow path 110 through the airfoil 102*a* flows upward on the page from the inner diameter 106 to the outer diameter 108. Thus, in this instance, the airflow passing through the leading edge passage is in a radial flow direction. As such, the dimensions that define aspect ratio of the channel defining the leading edge passage would be in an axial orientation (i.e., left-to-right on the page) and a circumferential orientation (i.e., in and out of the page). In one example, for illustrating and explaining the nomenclature related to aspect ratios, the axial dimension of this leading channel is longer than the circumferential dimension. That is, the left-to-right dimension is longer than the dimension of the channel in the direction into/out of the page (e.g., from a pressure side to a suction side, as will be appreciated by those of skill in the art). Because the axial dimension is the longer of the dimensions that is perpendicular to a flow direction through the leading edge channel, the leading edge channel has an "axial aspect ratio."

Accordingly, as noted above and as used herein, the "name" of an aspect ratio is defined as the direction of the longest dimension of a channel that is perpendicular to a direction of flow through the channel (e.g., axial, radial, circumferential). Thus, as described above, an aspect ratio of a channel within an airfoil having air flowing from the inner diameter to the outer diameter has a radial flow direction. With a "space-eater" baffle installed within such an airfoil, the longest dimension that is perpendicular to the flow direction is the axially oriented dimension and the circumferentially oriented dimension is the shorter dimension. As such, the channel has an "axial aspect ratio." An axial aspect ratio can also have a direction of cooling flow in a circumferential direction, with the shorter dimension of the channel having a radial orientation. A "circumferential aspect ratio" channel is one that has a flow direction in either the radial or axial flow direction, with the longest dimension of the channel that is perpendicular to the flow direction having a circumferential orientation. Similarly, a "radial aspect ratio" channel is one that has an axial or circumferential flow direction, with the longest dimension of the channel that is perpendicular to the flow direction being circumferentially oriented.

The above described limited radial distance at the turning of airflows passing through airfoils may alter the direction of the channels and, thus, the associated aspect ratios. For example when transitioning from a radial flow direction to an axial flow direction, a flow passage may transition from an axial aspect ratio channel to a circumferential aspect ratio channel. Once all the flow is travelling in the same direction, it can be merged.

Referencing FIGS. 2A-2D, schematic illustration of an airfoil 202 configured in accordance with an embodiment of the present disclosure is shown. The airfoil 202 may be a vane and similar to that shown and described above having a body that extends from an inner diameter platform 222 to an outer diameter platform 220. The airfoil 202 extends from a gas path surface 220*a* of the outer diameter platform 220 to a gas path surface 222*a* of the inner diameter platform 222.

The airfoil 202 includes a plurality of interior airfoil cavities, with a first airfoil cavity 204*a* being an up pass of a serpentine cavity, a second airfoil cavity 204*b* being a down pass of the serpentine cavity, and a third airfoil cavity 204*c* being a trailing edge cavity. The airfoil 202 also includes a fourth airfoil cavity 204*d* that is a leading edge cavity. As illustratively shown, a cooling flow of air can follow an airflow path 210 by entering the airfoil 202 from the inner diameter, flowing upward to the outer diameter through the up pass of the first airfoil cavity 204*a*, turning at the outer diameter turning cavity 246, downward through the down pass of the second airfoil cavity 204*b*, turning at the inner diameter turning cavity 248, and then upward and out through the third airfoil cavity 204*c*. As shown, the first and second airfoil cavities 204*a*, 204*b* are configured with baffles 238*a*, 238*b* inserted therein.

To provide sufficient cooling flow and control of cooling air pressure within the airflow path 210, the airfoil 202 is provided with a first turn cap 242 and a second turn cap 244. The first turn cap 242 defines a first turning cavity 246 therein. Similarly, the second turn cap 244 defines a second turning cavity 248 therein. As illustratively shown, the first turn cap 242 is positioned at an outer diameter 208 of the airfoil 202 and fluidly connects the first airfoil cavity 204*a* with the second airfoil cavity 204*b*. The second turn cap 244 is positioned at an inner diameter 206 of the airfoil 202 and fluidly connects the second airfoil cavity 204*b* with the third airfoil cavity 204*c*. The first and second turning cavities 246, 248 define portions of the cooling airflow path 210 used for cooling the airfoil 202. The turn caps 242, 244 are attached to respective non-gas path surfaces 220*b*, 222*b* of the platforms 220, 222.

The first and second turn caps 242, 244 move the turn of the airflow path 210 outside of the airfoil and into the cavities external to the airfoil (e.g., within outer diameter cavity 118 and inner diameter cavity 114 shown in FIG. 1B) and outside the hot gas path region which is typically constrained between the outer diameter and inner diameter gas path surfaces 120*a*, 122*a* of the respective platforms 120, 122, as shown in FIG. 1B. As such, there is significantly lower heat flux that exists outside of the hot gas path region. In this embodiment, the first and second turn caps 242, 244 serve as conduits for the internal cooling air flow to be transitioned toward the outer perimeter of the "space-eater" baffles 238*a*, 238*b*. In this instance, the "space eater" baffles consume a significant portion of the unobstructed cooling channels creating significantly smaller cooling channels 204*a* immediately adjacent to the external airfoil side wall surfaces along the entire radial distance of the airfoil surface (as shown in FIG. 2D). The redirection of cooling air flow around the perimeter of the "space-eater" baffles into the smaller cross-sectional area cooling channels 204*a* enables significantly higher internal cooling air flow Reynolds Numbers to be obtained. The increase in cooling air flow per unit area results in a higher internal convective heat transfer coefficient to be achieved along the entire radial cooling cavity immediately adjacent to the surface of an airfoil external sidewall 205 within the body of the airfoil 202 (as shown in FIG. 2D). In this embodiment, the turn caps 242, 244 are manufactured as separate parts or pieces that are welded or otherwise fixedly attached to the platforms 220, 222.

As shown illustratively, the first turn cap 242 and the second turn cap 244 have different geometric shapes. The turn caps in accordance with the present disclosure can take various different geometric shapes such that a desired air flow and pressure loss characteristics can be achieved. For example, a curved turn cap may provide improved and/or controlled airflow at the turn outside of the airfoil body. Other geometries may be employed, for example, to accommodate other considerations within the gas turbine engine, such as fitting between the platform and a case of the engine. Further, various manufacturing considerations may impact turn cap shape. For example, flat surfaces are easier to fabricate using sheet metal, and thus it may be cost effective to have flat surfaces of the turn caps, while still providing sufficient flow control.

Figure 2A:
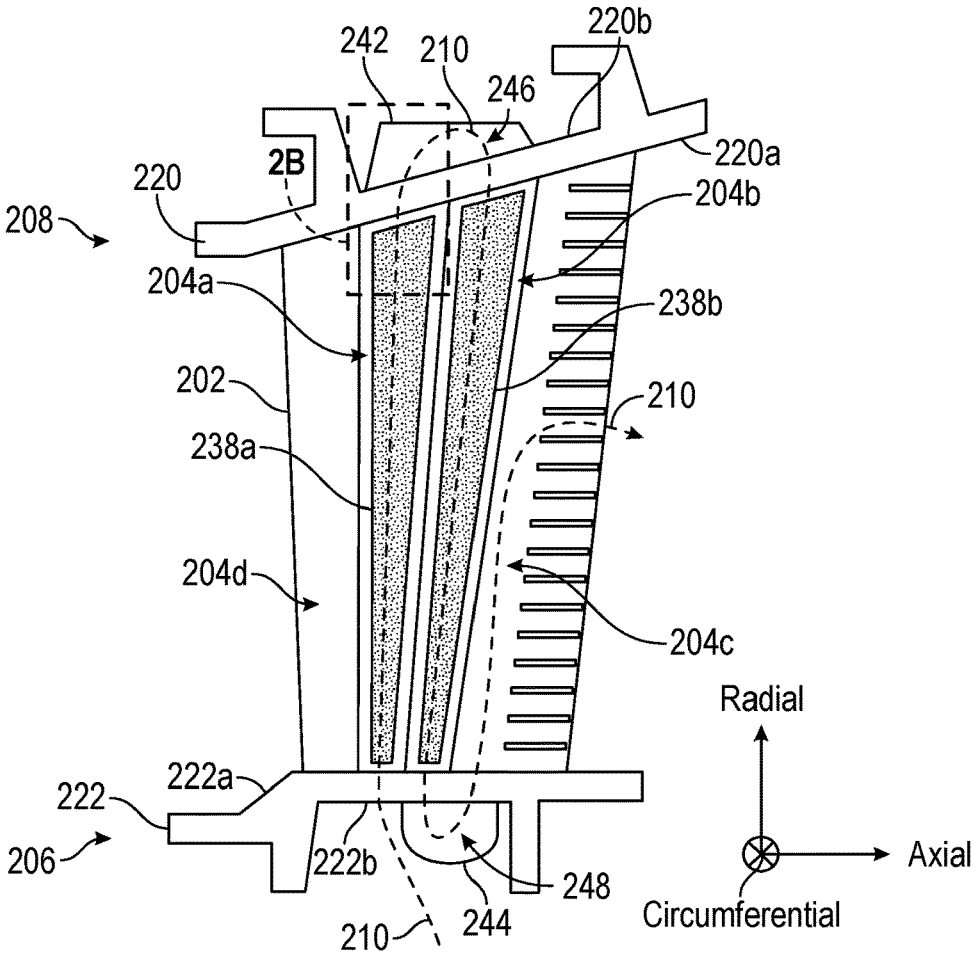
FIG. 2A is a schematic illustration of an airfoil configured in accordance with a non-limiting embodiment of the present disclosure.
Figure 2B:
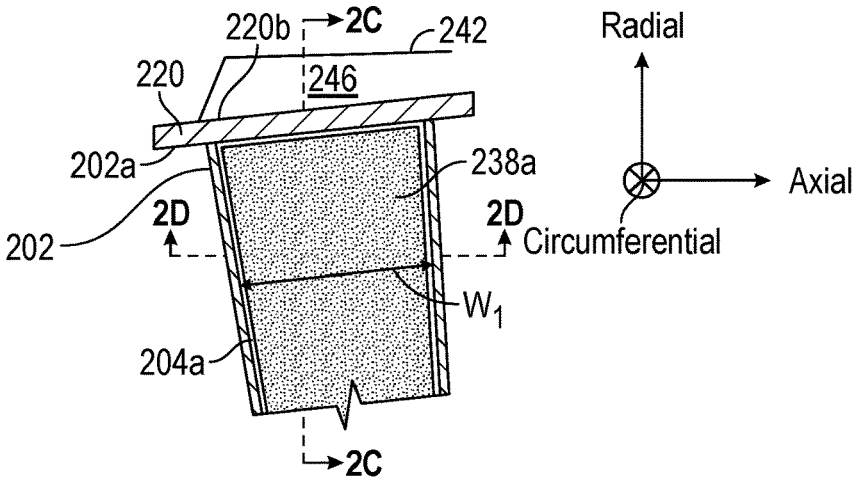
FIG. 2B is an enlarged illustration of a portion of the airfoil of FIG. 2A as indicated in the box 2B of FIG. 2A.
Figure 2C:
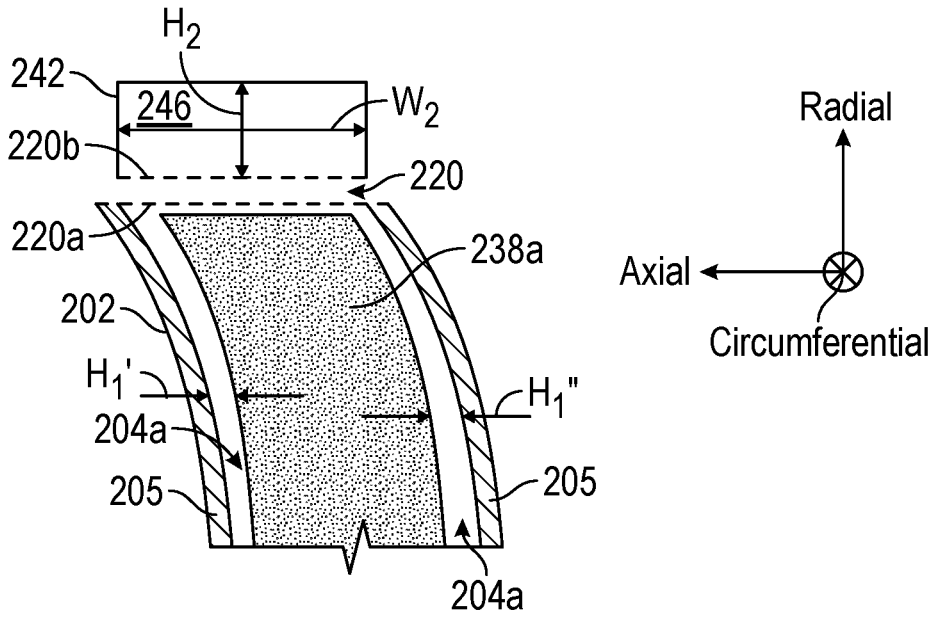
FIG. 2C is a cross-sectional illustration of the airfoil of FIG. 2A as viewed along the line 2C-2C of FIG. 2B.
Figure 2D:
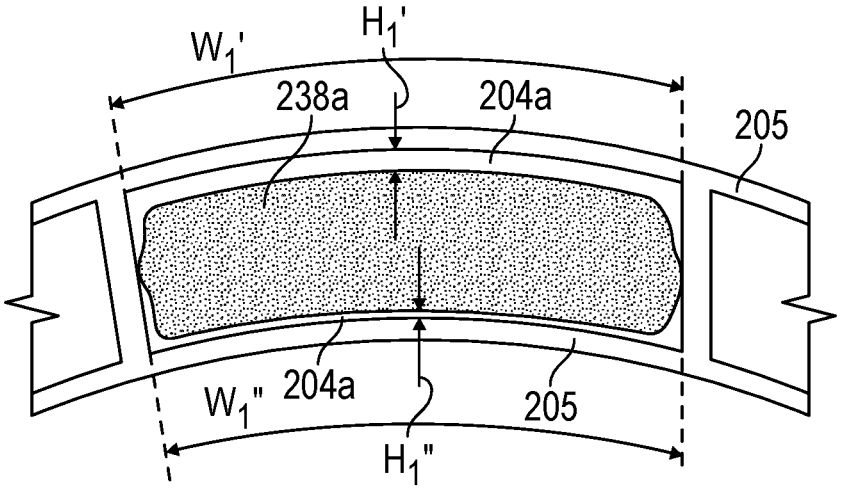
FIG. 2D is a cross-sectional illustration of the airfoil of FIG. 2A as viewed along the line 2D-2D of FIG. 2B.

As shown in FIGS. 2B-2C, enlarged illustrations of a portion of the airfoil 202 of FIG. 2A are shown. FIG. 2B illustrates an enlarged illustration of the box 2B indicated in FIG. 2A and FIG. 2C is a cross-sectional illustration along the line 2C-2C shown in FIG. 2B. As shown in FIG. 2B, the airfoil 202 includes the baffle 238*a* disposed within first airfoil cavity 204*a*. The airfoil 202 extends radially inward (relative to an axis of an engine) as indicated by the key shown in FIGS. 2A-2C. In FIGS. 2A-2C, the radial direction is outward relative to an engine axis (e.g., engine centerline longitudinal axis A shown in FIG. 1A) and is illustrated as upward on the page of FIGS. 2A-2C. The axial direction is along the engine axis and is shown indicated to the right in FIGS. 2A-2B and into the page of FIG. 2C. Those of skill in the art will appreciate that a circumferential direction is to the left/right in FIG. 2C (into/out of page of FIGS. 2A-2B).

As shown in FIGS. 2B-2D, air flowing through the first airfoil cavity 204*a* and into the first turning cavity 246 will change in aspect ratios with respect to the channel through which the flow passes. For example, when passing radially upward or outward within the first airfoil cavity 204*a*, the airflow will pass through a channel (e.g., first airfoil cavity 204*a*) defined by the airfoil external sidewalls 205 and the baffle 238*a*. The first airfoil cavity 204*a* and the baffle 238*a* define an axial aspect ratio of height-to-width of the channel. In this case the airflow channel has a first height $H_1'$, $H_1''$ which is a distance between a surface of the baffle 238*a* and a surface of an airfoil external sidewall 205 in the circumferential direction. As shown, and as will be appreciated by those of skill in the art, the first height $H_1'$, $H_1''$ can be different on the suction and pressure sides of the baffle 238*a*. However, in some embodiments, the first height $H_1'$, $H_1''$ is the same on both the pressure and suction airfoil external sidewalls 205. As shown in FIGS. 2B-2D, the first airfoil cavity 204*a* can have first width $W_1'$, $W_1''$, which as shown, is a distance in the substantially axial direction.

When the airflow passes into the first turn cap 242, the orientation of the aspect ratio changes to a circumferential aspect ratio channel. In this case, a second height $H_2$ is the height of the first turn cap 242 from the non-gas path surface 220*b* of the platform 220. The width of the airflow channel within the first turn cap 242 (second width $W_2$) is a distance between the pressure side and the suction side of the airfoil, as shown in FIG. 2C. As noted above, the limited radial height within the turn cap (e.g., second height $H_2$) may alter the available aspect ratios for the flow passages and, thus, the flow passage(s) will transition from an axial aspect ratio (within the airfoil) to a circumferential aspect ratio (within the turn cap). Once all the flow is travelling in the same direction, it can be merged.

Figure 3:
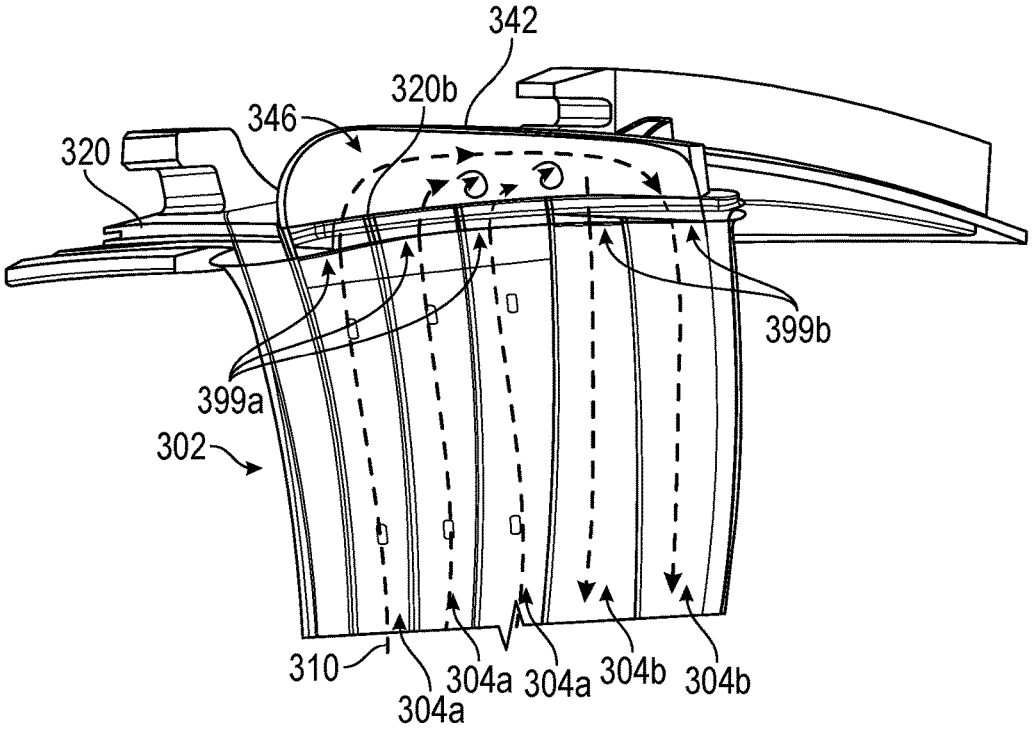
FIG. 3 is a schematic illustration of airflow through an airfoil having a turn cap installed thereto.

Turning now to FIG. 3, a schematic illustration of an airfoil 302 having a turn cap 342 mounted on a non-gas path surface 320*b* of a platform 320 is shown. Cavities of the airfoil 302 are fluidly connected to a turning cavity 346 within the turn cap 342 by means of cavity openings 399*a*, 399*b*, as described herein, that are formed in the platform 320.

As schematically shown, airflow 310 flows radially upward through the airfoil 302 along multiple up-pass first airfoil cavities 304*a*. The airflow passes from the up-pass cavities 304*a* through respective cavity openings 399*a* and into the turning cavity 346 of the turn cap 342. To direct the airflow 310 through cavities 399*b* and into multiple down-pass cavities 304*b*, the turn cap 342 is provided. However, as shown, as the different branches of the airflow 310 enter the turn cap 342 and merge, turbulence (and thus losses) may arise. That is, multiple air flow streams of varying velocities and pressures are merged and travel axially toward the trailing edge of the airfoil 302. Because the different flow streams of airflow 310 enter the turn cap 342 at different positions, some of the airflow will be moving axially (e.g., axially forward-entering air streams) while other streams will be flowing radially (e.g., axially aftward-entering air streams). As a result of the merging of multi-directional flow streams large eddies are generated (as schematically shown in FIG. 3) creating local turbulent vorticities which induce undesired pressure losses in the internal cooling air flow.

Accordingly, as provided herein, turn cap dividers are provided within the turn cap to keep the cooling flow separated into the individual passages as it transitions from a radial flow direction (axial aspect ratio) to an axial flow direction (circumferential aspect ratio). The turn cap dividers are configured and positioned to transition the airflow from the airfoil cavities into the turn cap to enable a smooth transition and merge one or more airflows without incurring significant pressure losses.

At the leading or axially forward edge of each turn cap divider, there is a first segment or transition surface that is configured to direct the cooling flow aft as it exits an airfoil cavity. In some embodiments, the first segment or transition surface is aligned to match up with a surface of a "space-eater" baffle that is located inside the radial passages of the airfoil and can prevent the baffle from travelling radially (e.g., operates as a stop surface). The downstream end of the "space-eater" baffles (e.g., at the platform) diffuses the cooling flow and helps the cooling flow transition from an axial aspect ratio to a circumferential aspect ratio channel.

In some embodiments, in order to allow the "space-eater" baffles to be inserted into the cavities of the airfoil, the turn cap dividers are installed after the baffles are installed. This can be done by creating a separate cap (e.g., turn caps as described herein) containing the turn cap dividers and is affixed to the platform of the airfoil. In some configurations, vane casting geometries can be configured to accommodate the turn cap dividers or separate landings or other structures in the vane casting can be formed to enable attachment of the turn cap dividers.

Figure 4A:
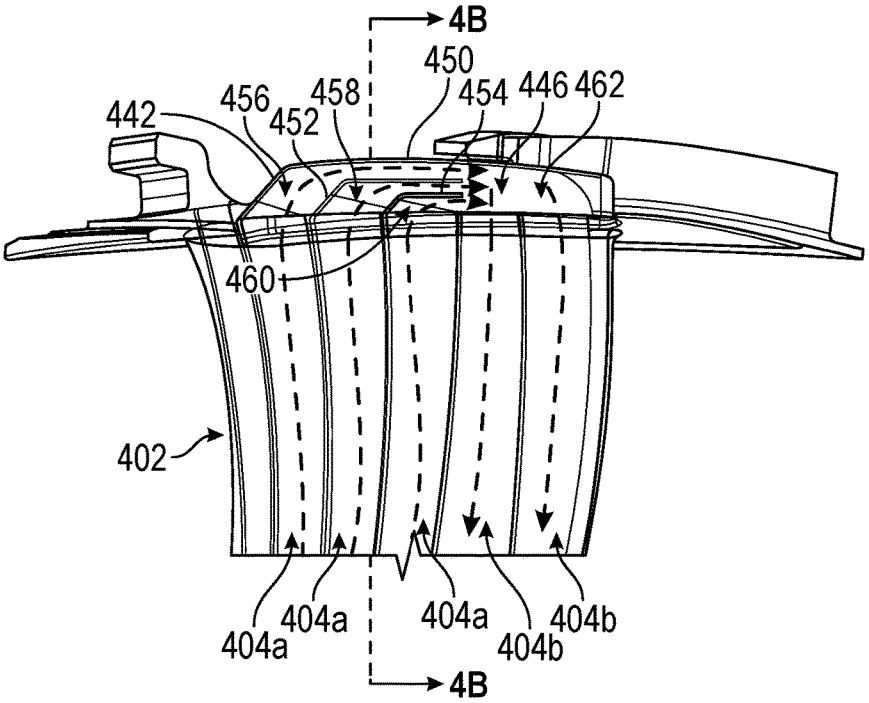
FIG. 4A is a schematic illustration of a turn cap in accordance with an embodiment of the present disclosure as attached to an airfoil.
Figure 4B:
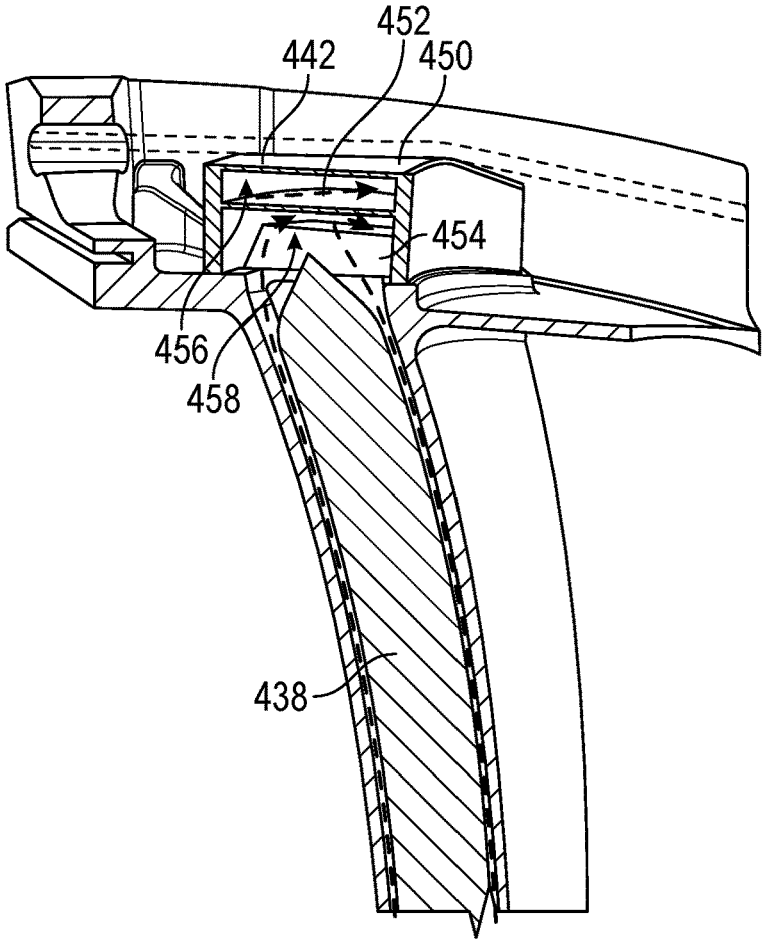
FIG. 4B is a cross-section illustration of the airfoil and turn cap of FIG. 4A as viewed along the line 4B-4B of FIG. 4A.
Figure 4C:
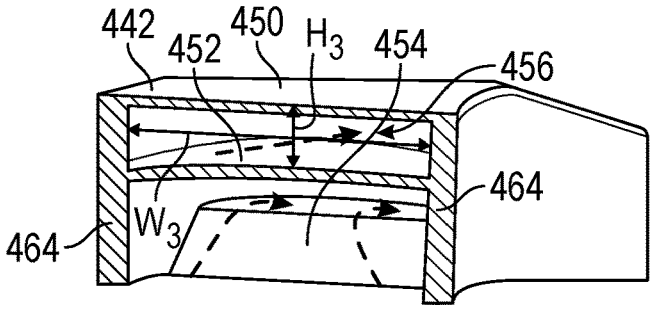
FIG. 4C is a schematic illustration of the turn cap of FIGS. 4A-4B shown in enlarged detail.

Turning now to FIGS. 4A-4C, schematic illustrations of an airfoil 402 configured with a turn cap 442 in accordance with an embodiment of the present disclosure are shown. FIG. 4A is a side view illustration of the airfoil 402 and the turn cap 442 and FIG. 4B is a cross-section illustration viewed along the line 4B-4B shown in FIG. 4A. FIG. 4C is an enlarged illustration of a portion of FIG. 4B illustrating dimensions within the turn cap 442. As shown, the airfoil 402 includes a plurality of first up-pass cavities 404*a* and two second down-pass cavities 404*b*. As shown, internal cooling air flows radially upward (outward) through the first up-pass cavities 404*a*, turns within the turn cap 442, and is merged prior to flowing radially downward (inward) into and through the two second down-pass cavities 404*b*.

The turn cap 442 is configured to keep the cooling flow streams in each passage (first up-pass cavities 404*a*) segregated until all of the flow streams have turned axial and are flowing in the same direction (e.g., parallel to each other). Such segregation in the turn can eliminate the pressure loss associated with turbulence caused by the merging of multi-directional air flow streams that are flowing with varying velocities and pressures. In addition, embodiments provided herein enable a means of transitioning the cooling passages from an axial aspect ratio to a circumferential aspect ratio in order to fit all of the passages within the limited radial height available within the turn cap.

To separate the flow, the turn cap 442 is configured with one or more turn cap dividers therein, with the turn cap dividers separating or dividing up a turning cavity 446 within the turn cap 442. For example, as shown in FIGS. 4A-4B, the turn cap 442 includes a first turn cap divider 450, a second turn cap divider 452, and a third turn cap divider 454. The first turn cap divider 450 defines an exterior surface or wall of the turn cap 442 and separated the turning cavity within the turn cap 442 from the outer diameter cavity (or inner diameter cavity) as described with respect to FIG. 1B. The second and third turn cap dividers 452, 454 separate the turning cavity of the turn cap 442 into three turning paths 456, 458, 460. As shown, a first turning path 456 is defined between the first turn cap divider 450 and the second turn cap divider 452, the second turning path 458 is defined between the second turn cap divider 452 and the third turn cap divider 454, and the third turning path 460 is defined radially inward of the third turn cap divider 454.

The first turning path 456 is fluidly connected to one of the first up-pass cavities 404*a*, the second turning path 458 is fluidly connected to a different one of the first up-pass cavities 404*a*, and the third turning path 460 is fluidly connected to a different one of the first up-pass cavities 404*a*. As illustratively shown, as the airflow enters the turn cap 442 into the respective turning paths 456, 458, 460, the airflow is turned from a radial flow direction to an axial and/or circumferential direction. Each of the turning paths 456, 458, 460 direct the airflow therein toward a merging chamber 462, wherein the fluid flow through the respective turning paths 456, 458, 460 is merged prior to flowing radially inward/downward into the second down-pass cavities 404*b*. The turn cap dividers 450, 452, 454 are formed or positioned parallel to each other such that the fluid flow from each of the turning paths 456, 458, 460 is parallel with the other turning paths as the fluid enters the merging chamber 462 and thus turbulence and losses can be minimized or eliminated when merging separate multi-directional internal air the flow streams from multiple cooling cavity channels and paths.

The turn cap 442 defines the multiple turning paths 456, 458, 460, with each turning path 456, 458, 460 having an aspect ratio that may be advantageous within the turn of the turn cap 442 and to maintain desired flow characteristics. For example, as shown in FIG. 4C, an enlarged illustration of the turn cap 442 is shown. As shown in FIG. 4C, the first turning path 456 has a height $H_3$ that is a distance between the first turn cap divider 450 and the second turn cap divider 452 that define the first turning path 456. The first turning path 456 has a width $W_3$ that is a distance between cavity sidewalls 464. The aspect ratio of the first turning path 456 is defined by a ratio of height $H_3$ to width $W_3$ (which is a circumferential aspect ratio). The cavity sidewalls 464 define the axial extent of the turn cap 442 and, in this embodiment, are integrally formed as part of the turn cap dividers 450, 452, 545. Each of the turning paths 456, 458, 460 can have a circumferential aspect ratio that is the same or different. For example, the radial separation of the various turn cap dividers may be different and thus each turning path may have a different aspect ratio. In other embodiments each of the turning paths may have the same aspect ratio, at least for a portion of the axial extent of the turning paths.

Figure 5:
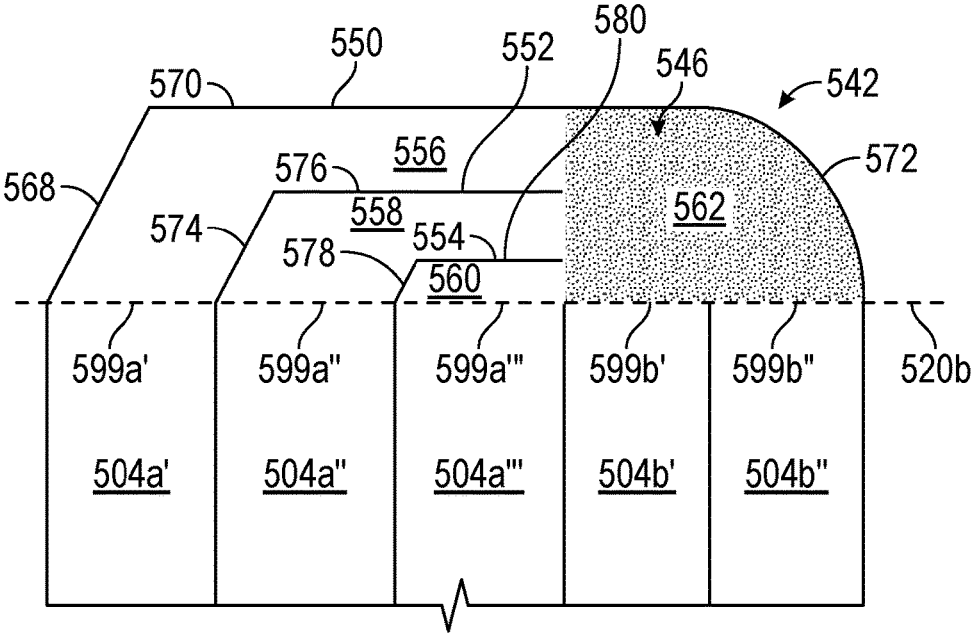
FIG. 5 is a cross-sectional illustration of a turn cap and airfoil in accordance with an embodiment of the present disclosure.

Turning now to FIG. 5, a schematic cross-sectional illustration of a turn cap 542 having a turning cavity 546 in accordance with an embodiment of the present disclosure is shown. The turn cap 542 and turning cavity 546 may be substantially similar to that shown and described above and can be attached to a non-gas path surface 520*b* of a platform (as described above, schematically shown as a dashed line in FIG. 5). The turn cap 542 includes turn cap dividers 550, 552, 554 that define turning paths 556, 558, 560, as described above. Airflow from one or more up-pass cavities 504*a*', 504*a*", and 504*a*'" passes through the turning paths 556, 558, 560 is merged in a merging chamber 562. The first turning path 556 is fluidly sourced from a first up-pass cavity 504*a*' through a respective cavity opening 599*a*' formed in and passing through a platform of an airfoil. The second turning path 558 is fluidly sourced from a second up-pass cavity 504*a*" through a respective cavity opening 599*a*" formed in and passing through the platform of the airfoil. The third turning path 560 is fluidly sourced from a third up-pass cavity 504*a*'" through a respective cavity opening 599*a*'" formed in and passing through the platform of the airfoil. The cooling air flow flows radially upward/outward into turning paths 556, 558, 560, is merged within the merging chamber 562, and then flows radially downward/inward into a first down-pass cavity 504*b*' through a respective cavity opening 599*b*' and a second down-pass cavity 504*b*" through a respective cavity opening 599*b*". The up-pass cavities 504*a*', 504*a*", 504*a*'" and the down-pass cavities 504*b*', 504*b*" are cooling cavities within an airfoil, for example, as shown and described above.

Each of the turn cap dividers 550, 552, 554 can be formed of multiple segments to aid in flow control, and particularly with respect to turning of the airflow. As shown in FIG. 5, the first turn cap divider 550 includes a first segment 568, a second segment 570, and a third segment 572. The first segment 568 of the first turn cap divider 550 defines a geometry (e.g., contour, angle, slope, bend, curve, etc.) that can be optimized to aid flow turning. As shown in FIG. 5, the first segment 568 of the first turn cap divider 550 is an angled surface or wall of the turn cap 542. The first segment 568 of the first turn cap divider 550 extends radially (at an angle) away from the non-gas path surface 520*b* of the platform. The second segment 570 of the first turn cap divider 550 extends from the first segment 568 of the first turn cap divider 550 in an axial direction. The third segment 572 of the first turn cap divider 550 has a geometry (e.g., contour, angle, slope, bend, curve, etc.) that extends radially inward from the second segment 570 of the first turn cap divider 550 to the non-gas path surface 520*b* of the platform. The third segment 572 of the first turn cap divider 550 defines, in part, the merging chamber 562, and the contour of the third segment 572 of the first turn cap divider 550 can be optimized to direct the merged airflow into one or more down-pass cavities (e.g., cavities 504*b*', 504*b*").

Similar to the first turn cap divider 550, the second turn cap divider 552 and the third turn cap divider 554 each having respective first segments 574, 578 and second segments 576, 580. The first segments 574, 578 of the second and third turn cap dividers 552, 554 can have a contour configured to aid in turning flow from a radial direction to a predominantly axial/circumferential direction. The second segments 576, 580 of the second and third turn cap dividers 552, 554 may be parallel, converging, and/or diverging, and in some embodiments, may be parallel, converging, and/or diverging to the first segment 570 of the first turn cap divider 550. Although the dividing segments are shown as linear features, it will be appreciated that in some embodiments, the dividing segments may be curvilinear and/or comprise of varying local radii of convex and/or concave curvature and inclination angles and inflections. Further, as shown, the second segments 576, 580 of the second and third turn cap dividers 552, 554 terminate at the same axial location, with each of the independent turning path channels 556, 558, 560 having a common junction point within the turn cap 442, where the individual turning channels coalesce into merging chamber 562, as defined and illustrated as stippling in FIG. 5. However, in some embodiments, the termination point of the second segments 576, 580 of the second and third turn cap dividers 552, 554 does not have to be at the same axial location, and thus the shape of the merging chamber 562 is not necessarily as well defined as that shown in FIG. 5. For example, in some embodiments, the first and second turning paths 556 558 may merge (within the merging chamber 562)

at a point that is axially forward of the point where the fluid flow from the third turning path 560 is merged in the merging chamber 562.

The first segments 568, 574, 578, which can be contoured, angled, or otherwise arranged to deflect cooling flow from the radial passages aftward into an axial/circumferential flow (e.g., as shown and described herein). As the radially flowing air contacts the first segments 568, 574, 578, the flow is diffused and deflected aftward, but remains in separate passages. The flow vortices created by the mixing of multi-directional air flow streams of varying velocities, pressures, and temperatures will be significantly mitigated, and in turn minimize the inherent total pressure losses traditionally observed with highly turbulent flow structures. Further, the aspect ratio of the flow channels change from axial (within the airfoil) to circumferential (within the turn cap 542) to reduce radial channel height in order to enable installation within a case of a gas turbine engine, which may have very limited space. That is, by changing the turning cooling channels 556, 558, 560 to circumferential aspect ratio orientations, the turn cap size (in the radial direction) can be minimized. Advantageously, the turn cap 542 reduces pressure losses by aligning flow streams prior to merging of the flow streams within the merging chamber 562.

Although shown and described with respect to a specific geometry, those of skill in the art will appreciate that the turn cap and/or the turn cap dividers therein can have various shapes, angles, curves, contours, etc. without departing from the scope of the present disclosure. For example, the first segment of one or more of the turn cap dividers can be curved or contoured to provide a customized airflow surface in order to optically direct the air flow within the turning channels contained without the turn cap 442. The shaping may be in three dimensions, such that the angles and/or contours can be different and/or customized/optimized in the radial direction, the axial direction, and/or the circumferential direction.

Figure 6A:
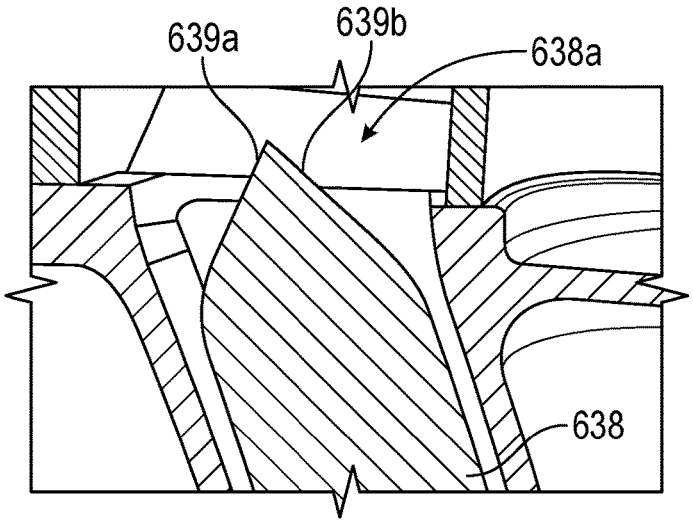
FIG. 6A is a cross-sectional illustration of a "space-eater" baffle enabled by embodiments of the present disclosure.
Figure 6B:
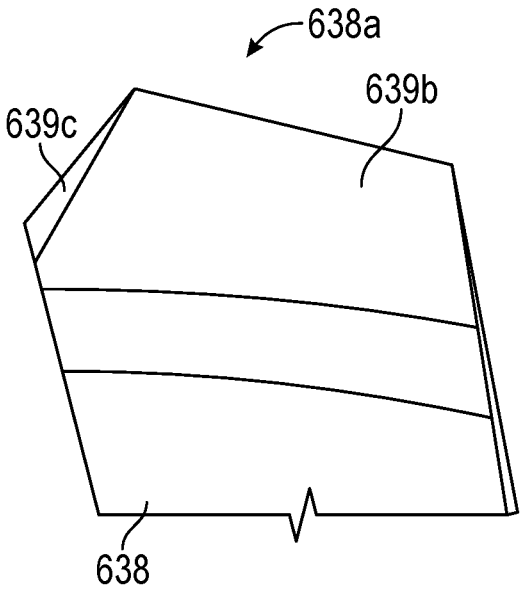
FIG. 6B is a side elevation illustration of a baffle end of the "space-eater" baffle of FIG. 6A.
Figure 6C:
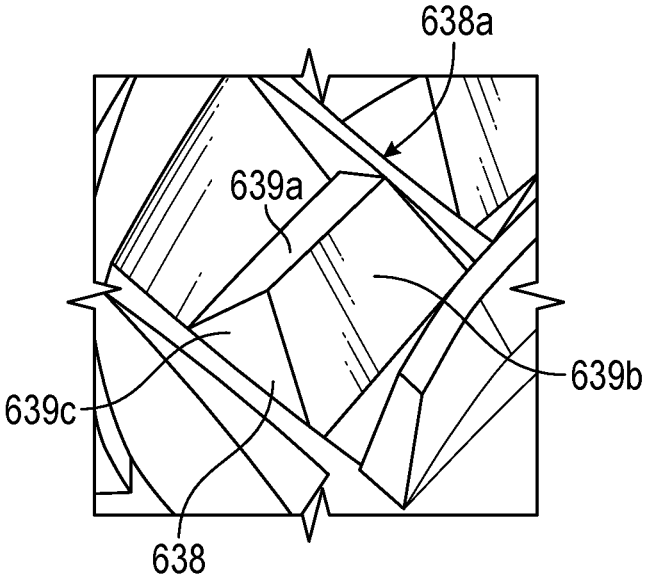
FIG. 6C is a top-down isometric illustration of the baffle end of the "space-eater" baffle of FIG. 6A.

Turning now to FIGS. 6A-6C, various schematic illustrations of an end of a baffle in accordance with an embodiment of the present disclosure are shown. The turn caps disclosed herein can enable the use of baffles which can provide additional flow control. For example, baffle end surface(s) on a baffle end can help diffuse the cooling flow as it transitions from an axial aspect ratio to a circumferential aspect ratio. Additionally, the ability to control the rate of diffusion of the cooling flow as it enters into the first turn cap 242 also minimizes the total pressure loss by mitigating the potential for flow separation associated with the sudden expansion of the internal cooling geometry as the flow is transitioned from an axial aspect ratio cooling channel to a circumferential aspect ratio cooling channel in the first turning cavity 246.

A non-limiting example of such angled end of a baffle is show in FIGS. 6A-6C. FIG. 6A is a cross-sectional illustration of a baffle end 638*a* of a baffle 638 as viewed in the axial direction (e.g., along the axis of an engine); FIG. 6B is a side elevation illustration of the baffle end 638*a*; and FIG. 6C is a perspective illustration of the baffle end 638*a*. As shown in FIGS. 6A-6C, the baffled end 638*a* can include multiple baffle end surfaces 639*a*, 639*b*, 639*c*. The baffle end surfaces 639*a*, 639*b*, 639*c* of the baffle end 638*a* can be contoured, curved, or have various other geometric shapes and thus are not limited to smooth, flat, or angled surfaces. In some embodiments, the shape of one or more of the baffle end surfaces 639*a*, 639*b*, 639*c* can be configured to match the shape, contour, angle, geometry, etc. of a first segment of a turn cap and/or a turn cap divider. As such, at least one surface of the baffle end surfaces 639*a*, 639*b*, 639*c* can be configured to engage with or otherwise contact a surface of the turn cap dividers and thus, the turn cap can operate as a stop to prevent radial, axial, and/or circumferential movement of the baffle 638 relative to an airfoil internal cooling cavity in which it is inserted.

Figure 7A:
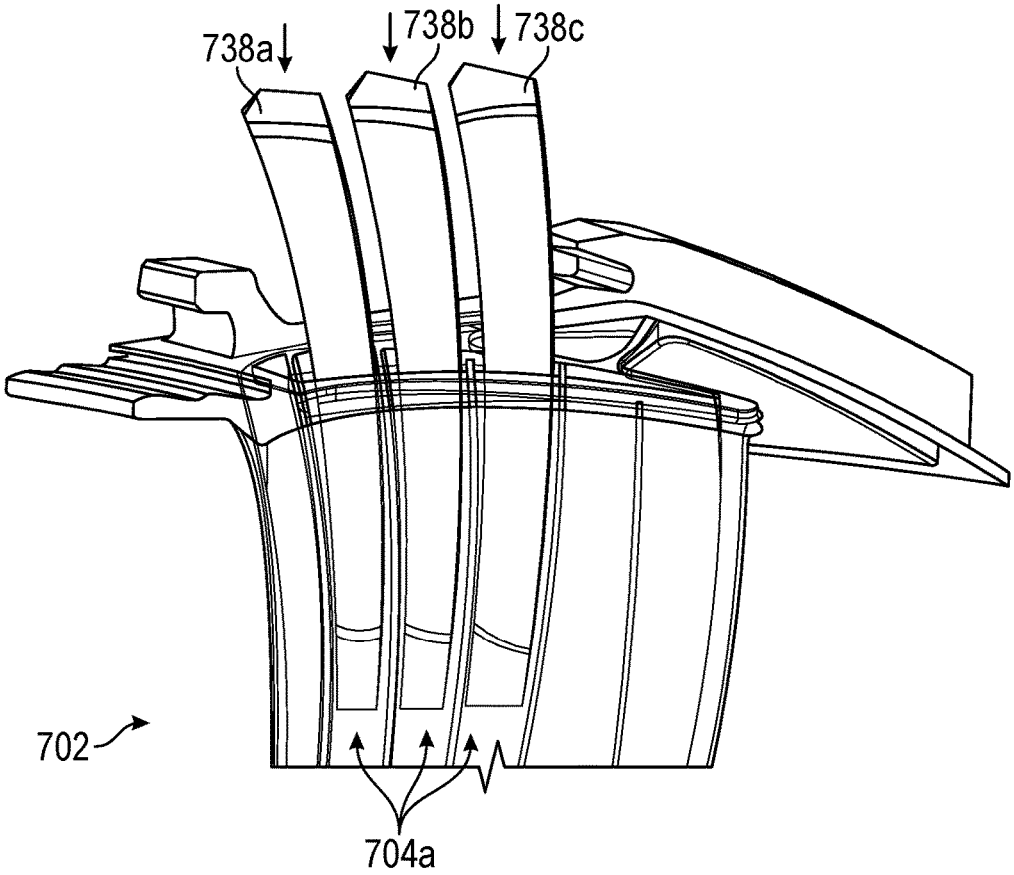
FIG. 7A is a side view illustration of part of a manufacturing process for forming an airfoil having a turn cap in accordance with an embodiment of the present disclosure.
Figure 7B:
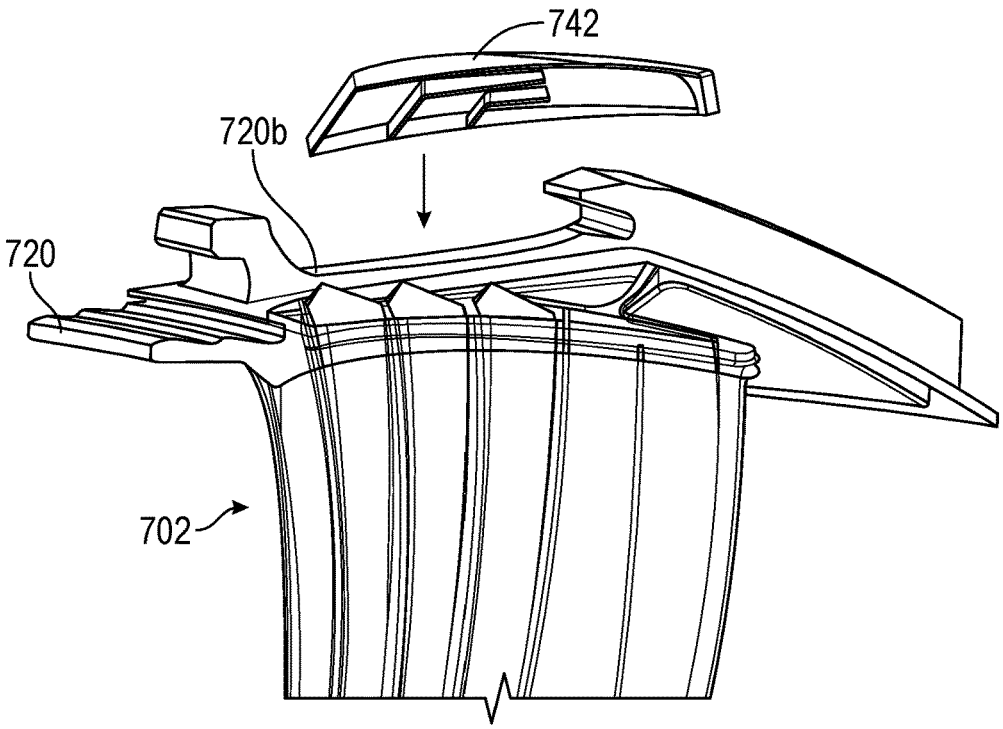
FIG. 7B is a side view illustration of part of a manufacturing process for forming an airfoil having a turn cap in accordance with an embodiment of the present disclosure.
Figure 7C:
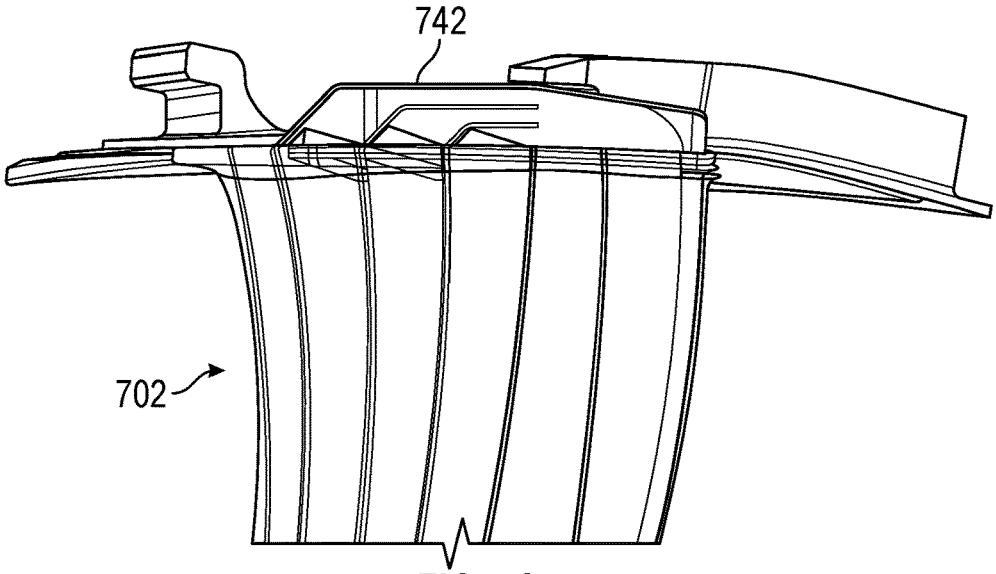
FIG. 7C is a side view illustration of part of a manufacturing process for forming an airfoil having a turn cap in accordance with an embodiment of the present disclosure.

Turning now to FIGS. 7A-7C, schematic illustrations of a manufacturing process of an airfoil having a turn cap in accordance with an embodiment of the present disclosure are shown. In FIG. 7A, a formed airfoil 702 has multiple "space-eater" baffles 738*a*, 738*b*, 738*c* inserted into cavities 704*a* of the airfoil 702. The baffles 738*a*, 738*b*, 738*c* are not physically attached within the airfoil 702 and thus may be free to move relative thereto. The cavities 704*a* may include stand-offs or other structures to position and support the baffles 738*a*, 738*b*, 738*c* within the cavities 704*a*, but actually attachment may not be present. With the baffles 738*a*, 738*b*, 738*c* inserted into the cavities 704*a*, a turn cap 742 is lowered into contact with a non-gas path surface 720*b* of a platform 720 of the airfoil 702, as shown in FIG. 7B. Then, as shown in FIG. 7C, the turn cap 742 is welded, brazed, or otherwise affixed in place such that the turn cap is fixedly attached to the non-gas path surface 720*b* of the platform 720.

In such an installation, the turn cap can be modified during development without having to change the vane casting (e.g., airfoil 702 and platform 720). As such, efficiencies in manufacturing enable a more rapid and cost effective optimization of the overall cooling design configuration. The ability to modify both "space-eater" baffle and turn cap geometric features without impacting the casting can enable increased flexibility in tailoring the relative cooling flow distributions and pressure losses in the configuration in order to achieve part durability and component performance and turbine efficiency metrics. Moreover, as noted above, portions of the turn caps can be designed to operate as stops to prevent radial, axial, and/or circumferential movement of the baffles 738*a*, 738*b*, 738*c*.

Figure 8A:
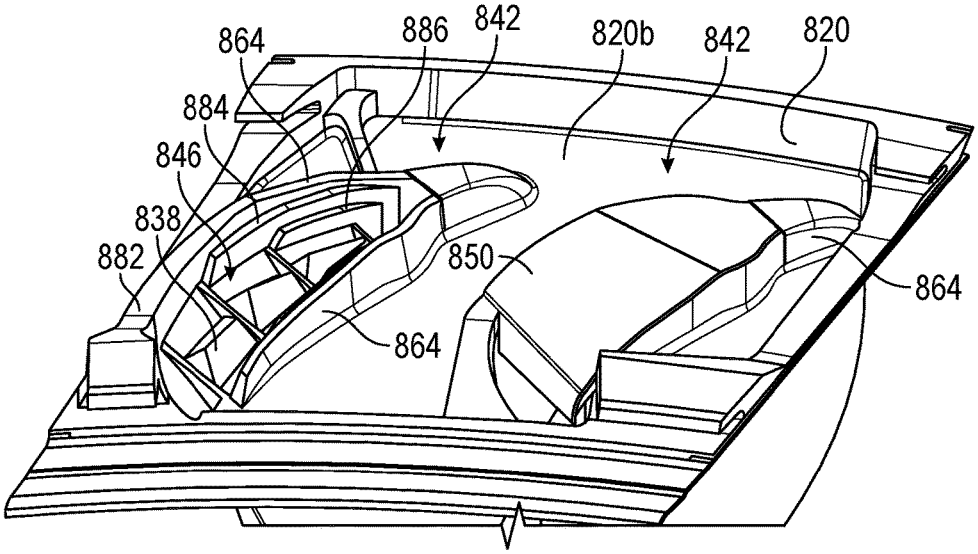
FIG. 8A is a top-down isometric illustration of an alternative configuration in accordance with the present disclosure.
Figure 8B:
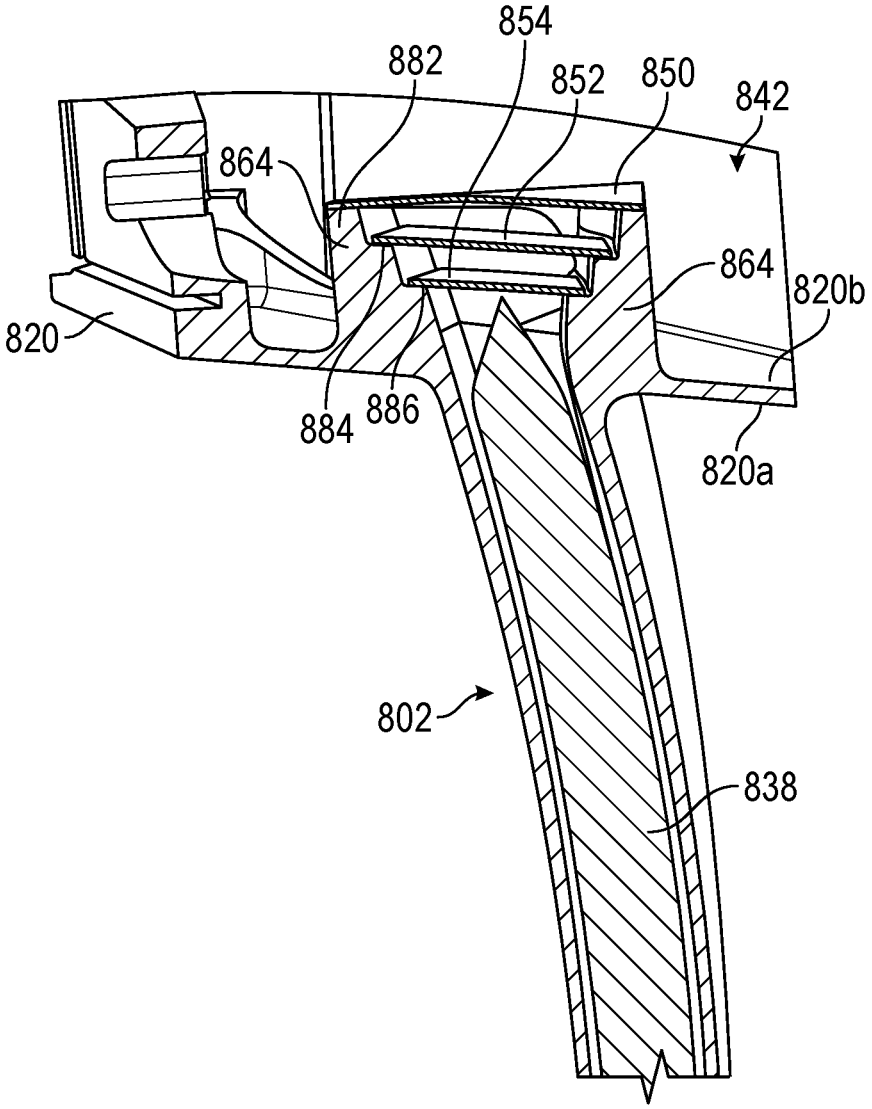
FIG. 8B is a cross-section schematic illustration of the configuration shown in FIG. 8A.

Turning now to FIGS. 8A-8B, schematic illustrations of an alternative configuration in accordance with an embodiment of the present disclosure are shown. FIG. 8A is a top down perspective illustration showing a platform 820 of an airfoil 802 having a turn cap 842 in accordance with the non-limiting alternative embodiment shown. FIG. 8B is an axially view cross-section of a portion of the airfoil 802 illustrating internal structure of the turn cap 842 of the current embodiment.

As shown in FIGS. 8A-8B, rather than employing a turn cap attachable to the platform, as shown and described above, the turn cap 842 includes a turning cavity 846 defined, in part, by part(s) of the platform 820. The platform 820 has a gas path surface 820*a* and a non-gas path surface 820*b*. Extending from the non-gas path surface 820*b* are cavity sidewalls 864. The cavity sidewalls 864, in some embodiments, can be formed during a casting process used to manufacture the airfoil 802 and the platform 820. As such, in the present embodiment, the cavity sidewalls 864 are integral with the platform and turn cap dividers 850, 852, 854 are separate and distinct therefrom.

The cavity sidewalls 864, as shown, are formed in a manner to receive one or more turn cap dividers 850, 852, 854 on respective landings 882, 884, 886. In the embodiment shown in FIGS. 8A-8B, the turn cap dividers 850, 852, 854 are fixedly attached to the cavity sidewalls 864 at the respective landings 882, 884, 886, such as by welding, braising, or other means. However, in other embodiments, the cavity sidewalls 864 can be formed with slots, tracks, or other features/structures to receive the turn cap dividers. That is, in some embodiments, the turn cap dividers can be slide into receiving structures and fixedly attached to the cavity walls. In one such embodiment, the first turn cap divider that forms an exterior surface of the turn cap can be fixedly attached on a respective first landing similar to that shown in FIGS. 8A-8B, although in some embodiments a slot or other structure can receive the turning first turn cap divider.

As shown in FIGS. 8A-8B, the landings 882, 884, 886 form a step-like structure in the cavity sidewalls 864. Accordingly, as the landings 882, 884, 886 are positioned radially inward or closer to the non-gas path surface 820*b* of the platform 820, a circumferential separation or distance decreases. As such, the respective turn cap dividers have different sizes, with the first turn cap divider 850 having the largest axial and circumferential dimensions, the second turn cap divider 852 having axial and circumferential dimensions less than the first turn cap divider 850, and the third turn cap divider 854 having axial and circumferential dimensions less than the second turn cap divider 852.

As will be appreciated by those of skill in the art, the turn cap dividers 850, 852, 854 of the embodiment shown in FIGS. 8A-8B, include first and second segments similar to that shown and described above and, thus, such discussion will not be repeated. Further, those of skill in the art will appreciate that because of the stepped landings 882, 884, 886 of the cavity side walls 864, the aspect ratios for each turning path defined between the turn cap dividers 850, 852, 854 will be different (e.g., the width of the turning paths will each be different). In some such embodiments, the height of the turning paths can be configured to achieve a desired aspect ratio for each turning path by adjusting the relative radial positions of the landings 882, 884, 886.

In view of the above, as provided herein, turn caps (or portions thereof) are formed as separate piece(s) and joined to the airfoil platform casting. In some configurations, optional "space-eater" baffles can be inserted into airfoil cavities before attaching the turn cap (or dividers thereof). The turn caps, as provided herein, may be cast, additively manufactured, formed from sheet metal, or manufactured by other means. Advantageously, as provided herein, by creating the turn caps as a separate, attachable element the end of the airfoil cavities are exposed, allowing insertion of the "space-eater" baffles.

Although various embodiments have been shown and described herein regarding turn caps for airfoils, those of skill in the art will appreciate that various combinations of the above embodiments, and/or variations thereon, may be made without departing from the scope of the invention. For example, a single airfoil may be configured with more than one turn cap with each turn cap connecting two or more adjacent airfoil cavities.

Advantageously, embodiments described herein provide turn caps that are fixedly attached to non-gas path surfaces of airfoil platforms to fluidly connect airfoil cavities of the airfoil and aid in turning airflow passing therethrough. Such turn caps can be used with serpentine flow paths within airfoils such that at least one up pass and at least one down pass of the serpentine cavity can be fluidly connected in external cavities outside of the core flow path of the gas turbine engine. The turn caps include turn cap dividers that are configured to turn fluid flow from one direction to another and enable efficient and low loss merging of multiple air streams.

Further, advantageously, such turn caps allow for installation of "space-eater" baffles into curved airfoils, such as bowed vanes, without interference with manufacturing requirements. Furthermore, advantageously, turn caps as provided herein can operate as stop structures to constrain and/or prevent radial, axial, and/or circumferential movement of the "space eater" baffles relative to the cooling channels and adjacent airfoil external sidewalls and ribs in which they are inserted to ensure optimal convective cooling, pressure loss, and thermal performance is maintained.

Moreover, advantageously, embodiments provided herein keep cooling flow streams in each passage separated until all of the flow streams have turned axial and aligned in the same direction, eliminating pressure losses associated with turbulence caused by the merging of flow streams in different directions. In addition, advantageously, a means of transitioning the cooling passages from an axial aspect ratio to a circumferential aspect ratio in order to fit all of the passages within the limited radial height available is provided. Additionally, advantageously, if the axial extending dividers and cavity sidewalls are part of unitary turning cap, modifications can be made just to the turn geometry without having to create a new vane casting.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although shown with bowed vanes, those of skill in the art will appreciate that airfoils manufactured in accordance with the present disclosure are not so limited. That is, any airfoil where it is desired to have a turn path formed exterior to an airfoil body can employ embodiments described herein.

Further, although shown and described with the dividers of the turn cap starting at an axially forward position (e.g., leading edge end of an airfoil) and the merging chamber at an axially aft position, those of skill in the art will appreciate that in some embodiments the opposite may be true. For example, a merging chamber can be at a forward end and the air within the forward end merging chamber can be separated by one or more dividers similar to that shown and described herein.

Furthermore, although shown and described with a single merging chamber, in some embodiment multiple merging chambers can be provided within a turn cap, and each merge chamber can be fluidly isolated from other merging chambers. For example, with reference to FIG. 5, the second segment 580 of the third turn cap divider 554 can extend to the right (downstream, toward the trailing edge) and then join with a divider within the airfoil between down-pass cavities 504*b*', 504*b*". In such configuration, the merging chamber 562 can be fed by only the airflow passing through first and second turn paths 556, 558. As such, air from the radially outward flowing first and second up-pass cavities 504*a*', 504*a*" will be turned and merged within the merging chamber and then directed into the radially inward flowing second down-pass cavity 504*b*". The airflow from the radially outward third up-pass cavity 504*a*'" is maintained separate from the merged flows and is turned to supply air into the radially inward flowing first down-pass cavity 504*b*'.

Those of skill in the art will appreciate that other various configurations and/or arrangements may be employed without departing from the scope of the present disclosure.

Accordingly, the present disclosure is not to be seen as limited by the foregoing description, but is only limited by the scope of the appended claims.

What is claimed is:

1. An airfoil of a gas turbine engine comprising:

a hollow body defining a first up-pass cavity, a second up-pass cavity, and a first down-pass cavity, the hollow body having an inner diameter end and an outer diameter end;

a first airfoil platform at one of the inner diameter end and the outer diameter end of the hollow body, the first airfoil platform having a gas path surface and a non-gas path surface, wherein the hollow body extends from the gas path surface;

a first up-pass cavity opening formed in the non-gas path surface of the first airfoil platform fluidly connected to the first up-pass cavity;

a second up-pass cavity opening formed in the non-gas path surface of the first airfoil platform fluidly connected to the second up-pass cavity;

a first down-pass cavity opening formed in the non-gas path surface of the first airfoil platform fluidly connected to the first down-pass cavity; and a first turn cap fixedly attached to the first airfoil platform on the non-gas path surface covering the first and second up-pass cavity openings and the first down-pass cavity opening of the first airfoil platform and defining a first turning cavity, the first turn cap having:

cavity sidewalls;

a first turn cap divider extending between the cavity sidewalls and defining the first turning cavity between the first turn cap divider and the cavity sidewalls; and a second turn cap divider disposed radially inward within the first turning cavity between the first turn cap divider and the non-gas path surface of the first airfoil platform, wherein a first turning path is defined between the first turn cap divider and the second turn cap divider and a second turning path is defined radially inward of the second turn cap divider, and wherein a merging chamber is formed in the turn cap wherein fluid flows through the first turning path and the second turning path are merged, the first turning cavity including the first turning path, the second turning path, and the merging chamber.

2. The airfoil of claim 1, wherein the cavity sidewalls, the first turn cap divider, and the second turn cap divider are integrally formed.

3. The airfoil of claim 1, wherein the cavity sidewalls are integrally formed with the first airfoil platform.

4. The airfoil of claim 3, wherein the first turn cap divider and the second turn cap divider are fixedly attached to the cavity sidewalls.

5. The airfoil of claim 4, wherein the cavity sidewalls include a first landing and a second landing, wherein the first turn cap divider is fixedly attached to the first landing and the second turn cap divider is fixedly attached to the second landing.

6. The airfoil of claim 5, wherein a distance between the first landings of the cavity sidewalls is greater than a distance between the second landings of the cavity sidewalls.

7. The airfoil of claim 1, wherein the first turn cap divider has a first segment and a second segment, wherein first segment has a geometry to turn flow.

8. The airfoil of claim 7, wherein the second turn cap divider has a first segment and a second segment, wherein the second segment of the second turn cap is parallel to the second segment of the first turn cap divider.

9. The airfoil of claim 1, wherein the first turning path and the second turning path each define circumferential aspect ratios.

10. The airfoil of claim 1, further comprising:

a second airfoil platform at the other of the inner diameter end and the outer diameter end of the hollow body; and a second turn cap fixedly attached to the second airfoil platform.

11. The airfoil of claim 1, further comprising a "space-eater" baffle positioned in at least one of the up-pass cavities.

12. A turn cap for an airfoil of a gas turbine engine, the turn cap comprising:

cavity sidewalls;

a first turn cap divider extending between the cavity sidewalls and defining a turning cavity between the first turn cap divider and the cavity sidewalls; and a second turn cap divider disposed radially inward within the turning cavity, wherein a first turning path is defined between the first turn cap divider and the second turn cap divider and a second turning path is defined radially inward of the second turn cap divider, and wherein a merging chamber is formed in the turn cap wherein fluid flows through the first turning path and the second turning path are merged, the merging chamber, the first turning path, and the second turning path forming the turning cavity, wherein the cavity sidewalls include a first landing and a second landing, wherein the first turn cap divider is fixedly attached to the first landing and the second turn cap divider is fixedly attached to the second landing.

13. The turn cap of claim 12, wherein the cavity sidewalls, the first turn cap divider, and the second turn cap divider are integrally formed.

14. The turn cap of claim 12, further comprising a platform of an airfoil, wherein the cavity sidewalls are integrally formed with the platform.

15. The turn cap of claim 14, wherein the first turn cap divider and the second turn cap divider are fixedly attached to the cavity sidewalls.

16. The turn cap of claim 12, wherein a distance between the first landings of the cavity sidewalls is greater than a distance between the second landings of the cavity sidewalls.

17. The turn cap of claim 12, wherein the first turn cap divider has a first segment and a second segment, wherein first segment has a geometry to turn flow.

18. The turn cap of claim 17, wherein the second turn cap divider has a first segment and a second segment, wherein the second segment of the second turn cap is parallel to the second segment of the first turn cap divider.

19. The turn cap of claim 12, wherein the first turning path and the second turning path each define circumferential aspect ratios.

* * * * *